United States Patent [19]

Bockno

[11] 4,242,405

[45] Dec. 30, 1980

[54] VISCOSE RAYON AND METHOD OF MAKING SAME

[75] Inventor: Gregory C. Bockno, Media, Pa.

[73] Assignee: Avtex Fibers Inc., Valley Forge, Pa.

[21] Appl. No.: 3,680

[22] Filed: Jan. 15, 1979

Related U.S. Application Data

[63] Continuation-in-part of Ser. No. 795,059, May 9, 1977, abandoned, which is a continuation of Ser. No. 664,773, Mar. 8, 1976, abandoned.

[51] Int. Cl.[2] ..... D01F 2/06; D02G 3/00

[52] U.S. Cl. ..... 428/224; 264/188; 428/370; 428/373; 428/393; 428/397; 428/400

[58] Field of Search ..... 428/397, 373, 374, 393, 428/400, 224, 370; 264/188

[56] References Cited

U.S. PATENT DOCUMENTS

| | | | |
|---|---|---|---|
| 2,855,321 | 10/1958 | Bachlott | 106/165 |
| 3,019,509 | 2/1962 | Cox et al. | 428/393 X |
| 3,083,075 | 3/1963 | Saxton et al. | 264/197 |
| 3,103,732 | 9/1963 | Woodell | 428/393 X |
| 3,277,226 | 10/1966 | Bockno et al. | 264/198 |
| 3,713,964 | 1/1973 | Sasakara | 428/393 X |
| 3,720,743 | 3/1973 | Stevens et al. | 264/168 |

FOREIGN PATENT DOCUMENTS

| | | | |
|---|---|---|---|
| 42-11641 | 7/1967 | Japan | 264/188 |
| 42-25495 | 8/1967 | Japan . | |
| 43-1418 | 6/1968 | Japan | 264/188 |
| 43-4534 | 10/1968 | Japan . | |
| 45-2331 | 1/1970 | Japan | 264/188 |
| 48-4564 | 2/1973 | Japan | 264/188 |

*Primary Examiner*—Lorraine T. Kendell
*Attorney, Agent, or Firm*—Arthur R. Eglington

[57] ABSTRACT

High wet modulus viscose rayon fiber having a skin core structure and having a multi-lobular cross-section that imparts to fabrics an improved cover and hand properties similar to those of cotton. The fibers are formed from a modifier-free viscose. The elimination of the modifier reduces manufacturing costs and eliminates an environmental pollution problem created in the discharge of spinning baths containing modifiers.

12 Claims, 3 Drawing Figures

VISCOSE RAYON AND METHOD OF MAKING SAME

CROSS REFERENCE

This application is a continuation-in-part of my pending United States patent application Ser. No. 795,059, filed May 9, 1977, now abandoned; which, in turn, is a continuation of my United States Patent Application Ser. No. 664,773, filed Mar. 8, 1976, now abandoned.

This invention relates to the production of regenerated cellulose or viscose rayon fibers and filaments. More specifically the invention is directed to the production of high wet modulus type viscose rayon fibers and filaments.

Because of their strength, luster, softness and hand, viscose rayon fibers and filaments have had a wide acceptance. Low-wet modulus viscose rayon fibers typically referred to commercially as regular rayon, are characterized in fabric form by excessive shrinkage when wet and then dried, and by a relatively low modulus in the wet state. Such fibers have a wet modulus of about 2.5 to 3.0 gm./denier. On the other hand, the use of high wet modulus fibers in fabric has demonstrated their utility in terms of improved fabric yield and in overall fabric performance as it relates to consumer use.

Such fibers have a wet modulus of 5 to 15 gm./denier and this range encompasses typical wet modulus values for most cottons.

In the production of high tenacity viscose rayon fibers and filaments for use as reinforcement in molded rubber articles, such as tires, hose and the like, and in the production of high wet modulus viscose rayon fibers and filaments, it has been generally accepted practice to utilize certain modifying agents in the viscose, particularly polyalkylene glycols, ethoxylated fatty acids, fatty alcohols or fatty esters and ethoxylated higher aliphatic amines. In general, the use of the modifying agents has resulted in increases in the tenacity and abrasion resistance of the fibers and filaments.

The use of these modifying agents or additives has significantly increased the cost of the raw materials in the production of these fibers. In spinning, the additives are removed from the viscose by the spinning bath. No practical method has been devised for the recovery of these additives from the spinning bath and, accordingly, there is a gradual buildup of the additives and the additive reaction products in the spinning bath. While the inorganic salts may be recovered from the baths, the modifying agents and their reaction products are present in effluent wash waters routed to waste treatment. This is highly undesirable because they add appreciably to the biological oxygen demand (BOD) which must be lowered to a level to meet standards established by Federal and state agencies. The discharge of this class of modifying agents and their reaction products thereby poses a significant environmental problem which can only be resolved by considerable expense in waste treatment facilities and operation of same.

The present invention provides a method of producing high-wet modulus rayon fibers which are characterized generally by high strength, high wet modulus, a low water pickup and low shrinkage in fabric form but without the use of viscose modifiers.

The invention also provides viscose rayon fibers having high wet and conditioned moduli and high wet and conditioned strengths.

This invention further provides a more economical method of producing high wet modulus viscose rayon fibers and filaments. It also reduces BOD loading in waste treatment from the wash water of the process.

Other advantages of the invention will become apparent from the following description and claims.

Figure 1:
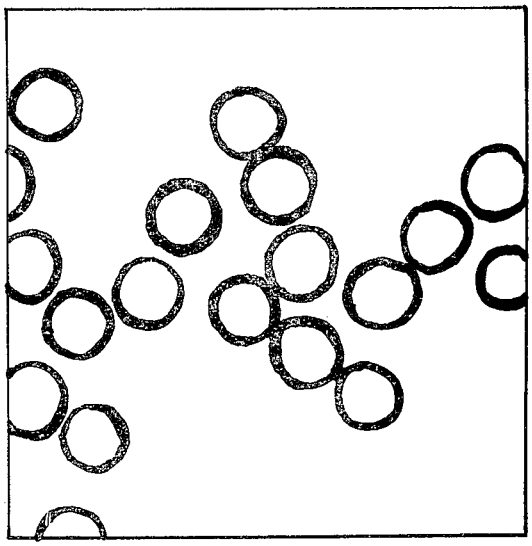
FIG. 1 is an enlarged (about 1000X) cross-sectional view of commercially available high wet modulus viscose rayon fibers.

The present invention contemplates the production of high strength, high wet modulus viscose rayon fibers by utilizing viscose and spinning baths having compositions within selected limits, and spinning the viscose under a limited range of conditions. The method is applicable to the production of either continuous filaments or staple fibers in a wide range of deniers in accordance with usual industry practice. In the production of staple fibers, the viscose solution is converted into a continuous filament and the staple fibers are produced by cutting the continuous filament to a desired length. Accordingly, the term "fiber" will be used in the specification and it is to be understood that the term is being used to designate both continuous filament and staple derived therefrom.

In the U.S. Pat. No. 3,277,226, to Bockno and DaVinci, there is disclosed a method of producing a high wet modulus fiber which has found wide commercial acceptance. A unique characteristic of the fiber is its high tensile strength in both wet and conditioned states.

The fibers of this invention may be used as a replacement for cotton in many textile constructions. They also may be blended with cotton. These fibers retain the usual desirable characteristics of rayon fibers, such as, processability, dyeability, fabric finishing, moisture regain. Both bright and delustered fibers can be made. Fabrics produced from these fibers are firm and cotton-like with respect to hand. This enhancement of fabric hand results from the unique combination of fiber cross-sectional shape and fiber modulus.

Fibers of this invention may be advantageously employed in blends with cotton, polyester, acrylic, or other synthetic fibers wherein the rayon content may be from 1 to 99%.

The wet modulus, expressed as grams per denier, as used herein is an average initial wet modulus which is defined as $$\text{wet modulus (g/d)} = \frac{\text{stress in g/d at 5\% elongation}}{0.05}$$

The wet modulus is a measure of the resistance of the wet fiber to stretching when subjected to tension.

Reported values of elongation herein represent the amount of stretching in a fiber placed under tension as percentage of original fiber length at the break point.

Measurements of wet modulus and elongation of single fibers may be made on an Instron Tensile Tester. The wet modulus of the viscose rayon fiber of the present invention varies between about 5.5 and 14 g/d, whereas low wet modulus rayon has a wet modulus of about 2.5 to 3 g/d. The elongation of this fiber is generally within the range of from 13% to 25% (preferably 18.5–22.5) when wet, and about 15% to 22% (preferably 16.5–19.5) in the conditioned state.

The tenacity of the fiber is generally within the range of from 2.0 to 3.5 grams per denier (preferably 2.1 to 2.5) when wet, and about 3.7 to 5.3 g/d (preferably 4.0 to 4.4) in the conditioned state.

As indicated, the high wet modulus fibers produced in accordance with U.S. Pat. No. 3,277,226 have highly desirable physical properties and characteristics. The necessity of utilizing the viscose modifiers, however, adds significantly to the cost of the raw materials, and creates significant additional costs needed to meet environmental water quality standards.

The fibers produced in accordance with that patent are characterized in having a substantially circular cross section with from about 25 to 30% skin. On the other hand, fibers made in accordance with the present invention do not require the use of modifying agents, thus eliminating costs associated with use of such agents and the attendant pollution problem. The present fibers have, in contrast, a highly desirable, irregular multilobular, skin core type cross-section which provides an improvement in fabric cover and hand, as previously mentioned. A measurement of skin-core relationship shows this fiber to have about 25% skin area disposed uniformly and continuously around the periphery of the core.

The fibers and filaments of the present invention are obtained by proper adjustment of the interrelated parameters of the viscose process, namely the viscose composition, the method of preparation, the spinning bath composition, and the spinning conditions. In general, the viscose contains from 5% to 9% cellulose and from 5% to 9% caustic soda. The cellulose xanthate of the viscose is prepared by addition of from about 30% to 42% (preferably 37% to 40%) carbon disulfide, based upon the weight of the cellulose to the alkali cellulose.

Alkali cellulose is prepared by steeping commercially available high quality dissolving grade wood pulp in steeping presses or in continuous steeping equipment using aqueous solution of caustic soda for up to about one hour at ambient temperatures. The alkali cellulose is pressed to a press weight ratio of about 2.8 to 2.9 : 1. The pressed alkali cellulose is shredded and mercerized in the usual manner. It is then xanthated by the addition of the major proportion of carbon disulfide.The resulting xanthated alkali cellulose is dissolved in a caustic soda solution and the balance of the carbon disulfide added during the dissolving step. The step-wise addition of carbon disulfide commonly referred to as split xanthation is not essential, it is merely an alternate procedure for accomplishing degree of xanthation desired.

In order to obtain optimum physical characteristics of the spun fibers, the viscose is ripened at a temperature between about 9° C. and 22° C. for up to about 30 hours (including the mixing and holding periods). Viscose formed as described will exhibit a salt test of from about 12 to 18 (preferably 14.5 to 16.5) and a spinning ball fall viscosity of 65 to 110 (preferably 75 to 90) seconds. The total sulfur content will vary from about 1.3 to about 3.2% and the xanthate sulfur will vary from about 1.0 to about 2.1%.

The spinning bath should contain between 5% and 8% sulfuric acid, 3% to 6% zinc sulfate and from 9% to 15% sodium sulfate. During spinning, the temperature of the bath should be maintained between about 30° and 48° C., and the spinning speed, as measured at the tow roll, should be about 20 to 40 meters per minute which results in a calculated residence time of the tow in the spin bath of 1 to 6 seconds. From the spinning bath, the filaments, prior to washing, are passed through a second bath or stretch bath maintained at a temperature between about 80° C. and 98° C., preferably between 80 and 90, and the filaments are stretched from about 85% to about 150% (preferably 95–110%) during the travel through this bath. As is well known, the residence time of the tow in the spin bath can be controlled to obtain the desired stretch specification.

The stretch bath may be a hot water bath, a very dilute solution of sulfuric acid, or it may be a diluted spinning bath containing from 0.5 to 6.0% sulfuric acid, 0.1 to 2.0% zinc sulfate and 1 to 7% sodium sulfate. The filaments and fibers produced are subsequently subjected to the normal after-treatments such as washing, desulfuring and bleaching by well known methods.

The following example is set forth illustrating the preparation of a representative high wet modulus fiber formed in accordance with U.S. Pat. No. 3,277,226. The fibers produced therefrom are used as a control for the fibers prepared in accord with the invention.

EXAMPLE I

Alkali cellulose was prepared by steeping a 98% α-cellulose rayon grade dissolving pulp in an 18% caustic soda solution and pressed to a press weight ratio of 2.85. The resulting alkali cellulose was shredded, mercerized, and subsequently xanthated by the addition of carbon disulfide. The cellulose xanthate was then dissolved in a caustic soda solution. 1.75% dimethyl amine and 3.5% of a polyoxyethylene glycol ether of phenol, containing an average of 15 ethylene oxide units per mol of phenol, was incorporated in the viscose during the mixing operation, the percentage being based upon the weight of the cellulose. The viscose solution thus prepared contained 7.5% cellulose and 7.5% caustic soda. It was prepared by the addition of 34% carbon disulfide based upon the weight of the cellulose. The viscose was then ripened in the usual manner at 18° C. for 12 hours. At the time of spinning, the viscose had a sodium chloride salt test of 10.2 and had a ball fall viscosity of 60 to 90 seconds. The total sulfur content was 2.18% and the xanthate sulfur was 1.6%.

The viscose was spun to form a 12,000 filament tow by extrusion of the viscose through orifices about 0.0025 in. diameter into a spinning bath containing 6.8% sulfuric acid, 3.7% zinc sulphate and 11% sodium sulphate, the spinning bath being maintained at a temperature of about 35° . The filaments were withdrawn from the bath, passed over a first godet to a second hot bath, the bath temperature being 95° C., over a second godet and then collected and after treated. The second bath was formed by diluting some of the spinning bath and contained about 3% sulfuric acid, about 1.5% zinc sulphate and about 5% sodium sulphate. During passage of the filaments through the hot bath, they were stretched approximately 150%. The spinning speed was 25 meters per minute. After collecting the fibers, they were washed, desulfurized and finished with a lubricant, and dried by usual methods. The fibers obtained had an average linear density of 1.5 denier.

A representative fiber of the present invention was formed in accordance with the following example:

EXAMPLE 2

Alkali cellulose was prepared by steeping a 98% α-cellulose rayon grade dissolving pulp in 19% aqueous caustic soda solution, and pressing the steeped sheets to a press weight ratio of 2.8, followed by shredding and mercerizing the resulting alkali cellulose. Two-stage xanthation was effected by introducing about 85% of the carbon disulfide to the alkali cellulose in the xanthator and the balance of the carbon disulfide was added to the mixer during dissolving of the xanthate in the caustic soda solution. The viscose thus prepared contained 7.5% cellulose, 7.5% caustic soda. A total of 37% carbon disulfide based upon the weight of the cellulose was added during xanthation and dissolving. The viscose was ripened at 10° C. to obtain at the time of spinning a sodium chloride salt test of 14.5–15.5 and a ball fall viscosity of 72 seconds. The total sulfur content was 2.30% and the xanthate sulfur was 1.66%.

The viscose was spun to form 12,000 filament tow by extrusion through orifices about 0.0025 in. in diameter into a spinning bath containing 6.3% sulfuric acid, 4.7% zinc sulfate and 11.0% sodium sulfate, the bath being at a temperature of about 42° C. The filaments were withdrawn from the bath, wrapped over a second godet, through a hot second bath, wrapped over a second godet, collected and after treated. The second bath was formed by diluting some of the spinning bath and contained about 3% sulfuric acid, about 1.5% zinc sulfate, and about 5% sodium sulfate and maintained at a temperature of 95° C. During passage of the filaments through the hot bath, they were stretched approximately 143%. The spinning speed was 25 meters per minute. After collecting the filaments they were washed, desulfurized, finished with a lubricant, and dried by usual methods.

A commercial staple of the present invention was formed in accordance with the following example:

EXAMPLE 3

Alkali cellulose was prepared by treatment of 98% α-cellulose rayon grade dissolving pulp with 18.5% caustic soda, pressing the steeped sheets to a press weight ratio of 2.8; and then shredding and mercerizing at 18° C. for 20 hours the resulting alkali cellulose. Xanthation was effected by one step addition of carbon disulfide. The viscose thus prepared contained 7.5% cellulose and 7.5% caustic soda. It was prepared by the addition of 38% carbon disulfide, based upon the weight of the cellulose. The viscose was ripened at 18° C. for about 22 hours. At the time of spinning the viscose had a sodium chloride salt test of 14.5–15.5 and an average ball fall viscosity of 80 seconds. The total sulfur content was 2.4% and the xanthate sulfur was 1.75%.

The viscose was spun to form 28,500 filament tow by extrusion through orifices about 0.0020 in. in diameter into a spinning bath containing 7.6% sulfuric acid, 3.9% zine sulfate and 12.0% sodium sulfate, the bath being at a temperature of about 38° C. The filaments were withdrawn from the bath, after a tow immersion of 24 inches, and wrapped on a godet and then passed through a hot regeneration bath, wrapped on a tow roll feeding cutter, cut and sluiced to a purification process machine. The regeneration bath was formed by diluting some of the spinning bath, and contained about 3.4% sulfuric acid, about 1.75% zinc sulfate and about 5.4% sodium sulfate and maintained at a temperature of 90° C. During passage of the tow filaments through the hot bath, they were stretched approximately 95–100%. The spinning speed was 29.1 meters per minute. The staple fibers were purified by washing, desulfurizing, finishing with a lubricant, and dried by usual methods. Linear density of the fiber made was 1.5 denier.

Rayon staple prepared as shown in this example was converted into a 180 count percale, 4 ounce fabric, made from a 50/50% blend of rayon and polyester. This fabric was compared with a like fabric of 50/50 combed cotton/polyester blend. Physical characteristics for these blended fabrics is set forth in Table IV. It is clear that fibers of this invention are converted to fabrics having characteristics comparable to cotton fabrics in this construction.

EXAMPLE 4

Alkali cellulose was prepared by steeping 96% α-cellulose, rayon grade dissolving pulp, in an 18% caustic soda solution and pressing to a press weight ratio of 2.85. By the usual techniques of steeping, a hemi-rich fraction of caustic soda was obtained and was reserved for use in viscose mixing.

The resulting alkali cellulose was shredded and mercerized at 18° for 20 hours. Xanthation was accomplished by one step addition of carbon disulfide. Virgin caustic soda mixed with hemi-rich reject soda and water was used to dissolve the xanthated crumb. After final mixing, the viscose had a composition of 7.5% cellulose, 7.5% caustic soda. It was prepared by the addition of 38% carbon disulfide (based on weight of cellulose).

The viscose was ripened at 18° C. for 20 hours. At the time of spinning the viscose had a sodium chloride salt test of 14.5–15.5 and a ball fall viscosity of 80. The total sulfur content was 2.51%.

The viscose was spun to form a 28,500 filament tow by extrusion through orifices having 0.0020 in. diameter in a spinning bath containing 7.7% sulfuric acid, 3.9% zinc sulfate, and 12.5% sodium sulfate. The bath temperature was 37°–38° C. The filaments were withdrawn from the bath after a tow immersion of 24″ and wrapped on a godet, and then passed through a hot regeneration bath and finally wrapped on a tow roll. The regeneration bath was formed by diluting some of the spin bath and contained 3.0% sulfuric acid, 1.5% zinc sulfate and 5.2% sodium sulfate and was maintained at a temperature of 90°–92° C. The tow filaments were stretched 96% between the godet and the tow roll with the tow roll delivering stretched tow at 29 meters per minute. The one was then fed to a cutter to produce staple fibers which were washed, desulfurized, and finished with a lubricant and dried by commercial rayon manufacturing methods.

EXAMPLE 5

Alkali cellulose was prepared by treatment of 98% α-cellulose rayon grade dissolving pulp with 18.5% caustic soda, pressing the steeped sheets to a press weight ratio of 2.8, and then shredding and mercerizing at 18° C. for 20 hours the resulting alkali cellulose. Xanthation was effected by one-step addition of carbon disulfide. The viscose thus prepared contained 7.5% cellulose and 7.5% caustic soda. It was prepared by the addition of 38% carbon disulfide, based upon the weight of the cellulose. The viscose was ripened at 18° C. for 20 hours. At the time of spinning the viscose had a salt test of 15.5 and an average ball fall viscosity of 85 seconds. The total sulfur content was 2.48% and the xanthate sulfur was 1.85%.

The viscose was spun to produce nominal deniers of (a) 1.25, (b) 2.25, and (c) 3.00. Table V presents a listing of the tow filaments, jet orifice diameter and spinning bath composition and temperature used for the respective deniers.

The tows spun under conditions of (a), (b), or (c) were withdrawn from the spin bath, after a tow immersion of 24 in., wrapped on a godet and then passed through a hot regeneration bath, wrapped on a tow roll feeding a cutter, cut and sluiced to a process machine. The regeneration bath had a composition and temperature equivalent to that described in Example 3. During passage of the tow filaments through the regeneration bath, they were stretched approximately 90–100%. The spinning speed was 29.1 meters/minute. The staple fibers were purified by washing and desulfurizing, finished with a lubricant and dried by usual methods. The linear densities, deniers, of the fibers produced in Parts A, B, and C of this example are shown in the table above.

The physical properties and characteristics of the fibers of Examples 1 through 3 are set forth in Table 1; those of Example 4 are similar to those shown in Example 3. Physical properties of the fibers of Example 5 are shown in Table V.

The Wet Stiffness Factor in Table 1 is wet through in grams per denier divided by % elongation in the wet state.

The Single Fiber Flex is measured on a Fiber Flex Tester made by Fiber Test, Inc., Arcweld Building, Grove City, Pennsylvania. This testing machine measures the resistance of single fibers to fatigue in flexure. In this apparatus, the test fiber secured to a reciprocating element, passes over a carefully machined bar having an edge closely ground to a diameter of approximately 0.0005 inch and the other end of the fiber is secured to a small weight (0.5 gm.). As the element is reciprocated, the filament is drawn across the edge of the bar. The number of cycles up to the time the filaments break is recorded. As reported in Table 1, 10 filaments were subjected to this test and the number of cycles is reported at the time the sixth of the ten fibers fail. This is considered the median value. This test is directly related to the wear properties of fabrics formed of the specific fibers. This method of testing fibers is described in an article by Lefferdink and Briar, "Interpretation of Fiber Properties", published in Textile Research Journal, Volume 29, June 1959.

Staple fibers produced as described in Examples 1 and 2 having a length of 1 ½ inches and a denier of 1.5 were processed on the cotton system to form 31/1 and 41/1 yarns. The yarns were utilized in weaving standard 75×78 print cloths, the 31/1 yarns being used as the warp yarns and the 41/1 yarns being used as the filling yarns. The processing of the staple fibers into the yarns was satisfactory and the performance in weaving was normal.

The physical properties of the fibers as used for the print cloth evaluation are as set forth in Table II.

Figure 2:
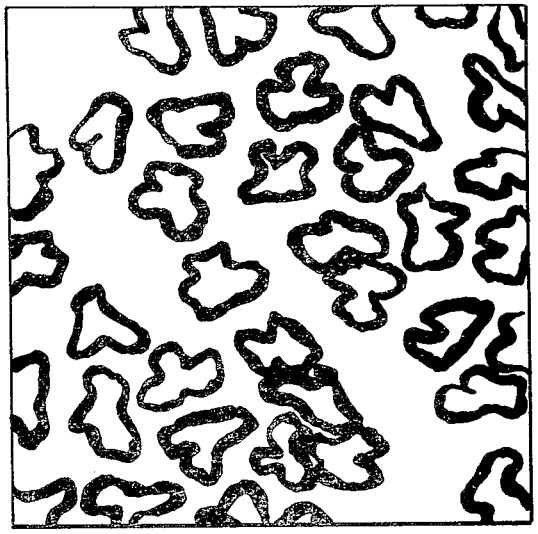
FIG. 2 is an enlarged (about 1000X) cross-sectional view of the viscose rayon fibers of this invention.
Figure 3:
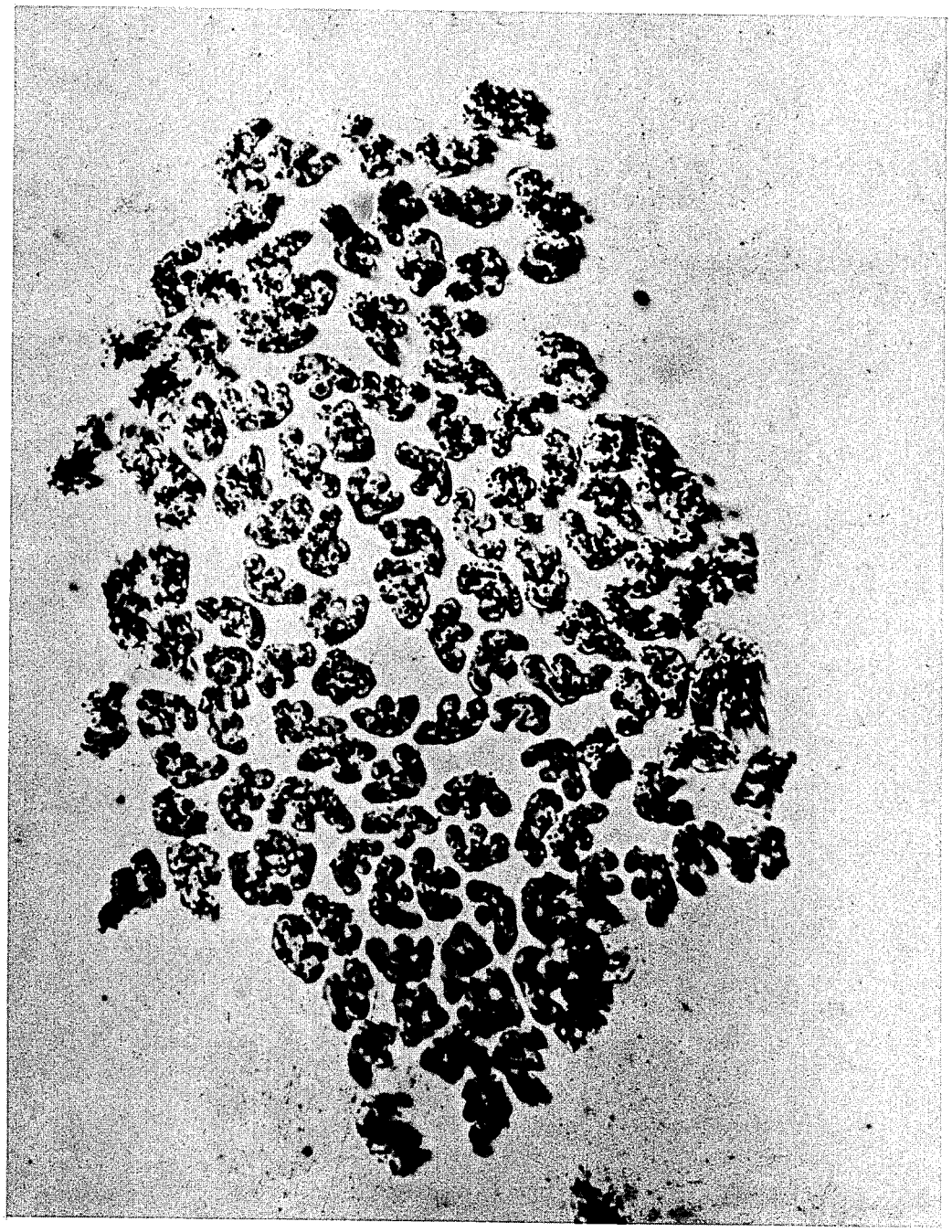
FIG. 3 is an enlarged (about 750X) cross-sectional photomicrograph of the fibers of this invention which have been pigmented.

The data presented in Tables I and II illustrate that the filaments and fibers prepared in accordance with the present method are comparable, for all practical purposes, to filaments and fibers prepared in accordance with the method disclosed in U.S. Pat. No. 3,277,226. The distinctive difference between the two products is that while the fibers prepared in accordance with the identified patent are substantially circular in cross-section as shown by FIG. 1, the fibers of the present method have a highly desirable, multi-lobular cross-section as illustrated by FIG. 2 and FIG. 3.

Physical properties of the fibers produced in Example 5 are shown in Table IV.

Fabric formed of fibers of the present invention exhibit significantly enhances (more than expected) fabric hand, being firm and lacking the limpness of rayon fabrics. The hand is similar to that of cotton, but this is not true of the fabrics made from fibers of Example 1. Fabric formed of fibers of the present invention also exhibit a distinct improvement in cover, as judged by their opacity which is visually readily observable and is further confirmed by light transmittance in standardized tests conducted on an Ozalid printer. These improvements in hand and cover are imparted by a combination of the multilobal cross section and the higher modulus. Both of these physical attributes lead to a low packing factor in yarns prepared from the fibers.

Table III summarizes other viscose and bath compositions and spinning conditions for the production of fibers representative of those of this invention. The fiber properties for these various process conditions are also listed in this table.

All samples identified in Table III represent fibers formed within the process condition ranges set forth herein before. In all instances, the viscoses were prepared as described in either Ex. 2 or 3. Each viscose was spun into the corresponding spinning bath composition shown in Table III to form either a 12,000 or a 28,500 filament tow at spinning speeds of 25 to 29 meters per minute. The stretch baths had approximately the same composition at the same temperature as that used in Example II. The fully processed and dried fibers had linear densities of 1.5 denier.

The present invention provides regenerated cellulose fibers having a wet tenacity of at least about 2.0 grams per denier, in general varying up to about 3.5 grams per denier. In the conditioned state, that is, after the fibers have been initially dried and then held in an atmosphere having a temperature of 75° F. (24° C.) and a relative humidity of 58% for twenty-four hours, the fibers have a tenacity of between about 3.7 and 5.3 grams per denier (preferably 4.0–4.4). The fibers have a wet modulus of between 5.5 and 14, a wet extensibility of between about 13% and 25% (preferably 18.5–22.5) and a conditioned extensibility of between about 15% and 22% (preferably 16.5–19.5). The fibers are further characterized in having a skin-core structure, wherein the core is surrounded by a continuous uninterrupted skin having a smooth periphery and being multi-lobular in cross-section.

The method of the present invention includes the use of a modifier-free viscose containing from 5% to 9% cellulose, from 5% to 9% caustic soda and from 30% to 42% carbon disulfide, based on the weight of the cellulose, ripened at a temperature of from 9° C. to 22° C. for up to about 30 hours and having a salt test of from about 12 to 18, such as, for example, 7.5% cellulose, ripened at 18° C. for 22 hours and having a salt test of 14.5 to 15.5. The viscose is spun at a spinning speed of 20 to 40 meters per minute into a spinning bath containing 5% to 8% sulfuric acid, 3% to 6% zinc sulfate and 9% to 15% sodium sulfate maintained at a temperature of between 30° C. and 48° C., such as, for example, 7.6% sulfuric acid, 3.9% zinc sulfate and 12% sodium sulfate maintained at about 38° C. The filaments are stretched from about 95% to 110% in a hot, dilute acid bath, 88° C. to 95° C., consisting of from 1% to 4% sulfuric acid, from 1% to 2% zinc sulfate and from 4% to 7% sodium sulfate, such as, for example, 3.4% sulfuric acid, 1.75% zinc sulfate and 5.4% sodium sulfate at a temperature of 90° C.

It is apparent from the foregoing disclosure that the present method results in a reduction in the fiber manufacturing cost by eliminating the need for viscose modifiers typically used for producing HWM fibers. The elimination of these viscose modifiers reduces costs with respect to the cost of the modifiers and of reducing BOD loading of plant effluent waste waters. The economic advantages are achieved in addition to obtaining the essential and desirable fibers properties, and the consequent desirable improvement in fabrics achievable with the fibers of this invention.

| | Average Fiber Properties | | |
|---|---|---|---|
| | Example 1 | Example 2 | Example 3 |
| Strength (Tenacity) g/denier | | | |
| Wet | 3.40 | 3.2 | 2.3 |
| Conditioned | 5.00 | 5.0 | 4.2 |
| Elongation, percent: | | | |
| Wet | 19 | 16.9 | 20.5 |
| Conditioned | 16 | 14.6 | 18 |
| Wet Modulus at 5% Elongation, g/d | 12 | 11.7 | 8 |
| Wet Stiffness Factor | 17.9 | 18.9 | 11.2 |
| Single Fiber Flex, cycles | 1500–2500 | 1500–2500 | N/A |
| Cross-Section | Round See FIG. 1 | Multi-lobular See FIG. 2 | Multi-lobular See FIG. 2 |
| Skin, percent | 25–30% | 25–30% | 25–30% |
| Water Retention, percent | 75–80% | 80–85% | 80–85% |
| Solubility, percent in 5% NaOH | 7–8% | 7–8% | 6–8% |

TABLE 11

| | Fibers | |
|---|---|---|
| | Example 1 | Example 2 |
| Tenacity, gms/den. | | |
| Wet | 3.66 | 3.21 |
| Conditioned | 5.05 | 5.22 |
| Elongation, % | | |
| Wet | 21.2 | 19.1 |
| Conditioned | 15.7 | 15.2 |
| Wet Modulus | 11.4 | 11.0 |
| Cross Section | Round | Irregular Multilobular |

TABLE 1V

| 50% Natural Multilobal Rayon/50% Polyester | | 50% Cotton/ 50% Polyester | |
|---|---|---|---|
| Tensile Strength (lbs) | W[1]94 | Tensile Strength (lbs) | W 93 |
| Elmendorf Tear (lbs) | W 2.5 | Elmendorf Tear (lbs) | W 2.4 |
| Shrinkage (120° F.) | Percent | Shrinkage (120° F.) | Percent |
| 5th Wash | $W_2O.O$ F 1.1 | 5th Wash | W 0.1 F 0.4 |
| Wash & Wear 5th Wash | 3.0[3] | Wash & Wear 5th Wash | 3.5 |

1 = Warp
2 = Fill
3 – Rating Scale of 1 to 5 (5 is best)

TABLE V

| | Linear Density | No. of Filaments in tow | Jet Orifice Diameter In. | Spinning Bath Composition % $H_2SO_4$ | % $ZnSO_4$ | % $Na_2SO_4$ | Temp. °C. |
|---|---|---|---|---|---|---|---|
| (a) | 1.25 | 28,500 | .0020 | 7.3 | 3.9 | 12.0 | 38 |
| (b) | 2.25 | 28,500 | .0020 | 7.7 | 3.9 | 12.5 | 38 |
| (c) | 3.00 | 17,600 | .0025 | 7.9 | 3.9 | 12.7 | 38 |

TABLE VI

| Average Physical Properties of Single Fibers of Example 5 | | | |
|---|---|---|---|
| | Part A | Part B | Part C |
| Denier | 1.27 | 2.26 | 3.03 |
| Strength (Tenacity) g/d | | | |
| Wet | 2.41 | 2.24 | 2.02 |
| Conditioned | 4.42 | 4.16 | 3.94 |
| Elongation, % | | | |
| Wet | 19.9 | 21.7 | 22.4 |
| Conditioned | 16.7 | 18.3 | 19.1 |
| Wet Modulus at 5% Elongation, g/d | 8.3 | 7.8 | 7.2 |

What is claimed is:

1. A regenerated cellulose fiber having a wet tenacity about 2.0 to 3.5 grams per denier, a conditioned tenacity of about 3.7 to 5.3 grams per denier, a wet extensibility between about 13% and 25%, a conditioned extensibility between 15% and 22%, and having a wet modulus between 5.5 and 14.0 and being further characterized in having a multilobular, skin core cross-section wherein the core is surrounded by a continuous uninterrupted skin, having a smooth periphery and having been formed by the method comprising preparing a modifier-

TABLE 111

| | Viscose-7.5% Cellulose | | | | | Spin Bath | | | | | Fiber Properties | | | | |
|---|---|---|---|---|---|---|---|---|---|---|---|---|---|---|---|
| Sample Ident. | NaOH % | $CS_2$* % | Age Temp. °C. | Age Time Hrs. | Salt Test | $H_2SO_4$ % | $ZnSO_4$ % | $NaSO_4$ % | Temp °C. | Stretch % | $T_w$ g/d | $T_c$ g/d | $E_w$ % | $E_c$ % | $M_w$ 5 |
| A | 6.5 | 34 | 12 | 22 | 10.9 | 5.0 | 5.4 | 11.3 | 35 | 134 | 2.96 | | 15.6 | | 12 |
| B | 7.5 | 34 | 12 | 22 | 10.6 | 6.0 | 4.0 | 11.0 | 35 | 134 | 2.93 | 4.42 | 15.9 | 13.0 | 11.4 |
| C | 7.5 | 34 | 12 | 22 | 10.7 | 6.4 | 5.2 | 11.0 | 30 | 134 | 3.02 | | 16.3 | | 11.2 |
| D | 7.5 | 31 + 3** | 12 | 22 | 11.0 | 5.8 | 5.3 | 11.0 | 35 | 138 | 3.15 | 4.50 | 18.0 | 14.6 | 10.4 |
| E | 7.5 | 34 + 3** | 10 | 22 | 13.2 | 7.2 | 5.0 | 11.0 | 35 | 117 | 3.16 | | 15.2 | | 14.4 |
| F | 7.5 | 31 + 6** | 10 | 22 | 15.3 | 6.6 | 5.1 | 10.5 | 42 | 147 | 3.4 | 5.3 | 19.0 | 15.8 | 11.4 |
| G | 7.5 | 37 | 10 | 22 | 13.3 | 6.7 | 4.8 | 10.6 | 42 | 134 | 3.2 | | 17.2 | | 12.6 |
| H | 7.5 | 31 + 9** | 10 | 22 | 17.4 | 6.7 | 6.6 | 11.6 | 42 | 138 | 3.3 | 4.65 | 17.9 | 12.4 | 12.6 |
| I | 7.5 | 33 + 4** | 10 | 22 | 14.5–15.5 | 6.3 | 4.7 | 11 | 42 | 143 | 3.2 | 5.0 | 16.9 | 14.6 | 11.7 |
| J | 7.5 | 38 | 18 | 22 | 14.5–15.5 | 7.6 | 3.9 | 12.0 | 38 | 98 | 2.3 | 4.2 | 20.5 | 18.0 | 8.0 |

**First figure indicates proportion initially added during churning; second figure indicates proportion added during dissolving step.
*The concentration of $CS_2$ is percentage based on cellulose.

free viscose containing from about 5% to 9% cellulose, from about 5% to 9% caustic soda and from 30% to 42% carbon disulfide based upon the weight of cellulose, ripening the viscose to a sodium chloride salt index of 12 to 18 and a spinning ball fall of between 65 and 110 seconds, extruding the ripened viscose into an aqueous spinning bath containing from about 5% to 8% sulfuric acid, from about 3% to 6% zinc sulfate and from about 9% to 15% sodium sulfate, maintained at a temperature between 30 degrees centigrade and 48 degrees centigrade, withdrawing the filaments through an aqueous stretch bath maintained at a temperature between 80 degrees centigrade and 98 degrees centigrade, and controlling residence time in the spin bath so as to allow stretching the filaments in the stretch bath from about 85% to 150%.

2. The fiber as defined in claim 1 wherein the viscose at the time of extrusion was ripened at a temperature between 9 degrees centigrade and 22 degrees centigrade for up to 30 hours and has a sodium chloride salt test of between 12 and 18 and said stretch bath contains 0.5% to 6% sulfuric acid, from 0.1% to 2% zinc sulfate and from 1% to 7% sodium sulfate.

3. The fiber as defined in claim 1 wherein the viscose contains about 7.5% cellulose, about 7.5% caustic soda and about 38% carbon disulfide, based upon the weight of the cellulose, and the viscose at the time of extrusion has a salt test of between 14.5 and 15.5.

4. The fiber as defined in claim 1 wherein the spinning bath contains about 7.6% sulfuric acid, about 3.9% zinc sulfate and about 12% sodium sulfate.

5. The fiber as defined in claim 1 wherein (a) the viscose contains about 7.5% cellulose, about 7.5% caustic soda and about 37% to 40% carbon disulfide and has a salt test of between 14.5 and 16.5, a spinning ball fall of between 75 and 90 seconds; (b) the spinning bath contains between 7.4% and 7.8% sulfuric acid, between 3.8% and 4.2% zinc sulfate, between 11% and 13% sodium sulfate and is maintained at a temperature between 37 and 42 degrees centigrade; and (c) the stretch bath contains between 0.5% and 6.0% sulfuric acid and is maintained between 88 and 95 degrees centigrade and the filaments are stretched in the bath about 95 to 110%.

6. The fiber as defined in claim 1 wherein the viscose contains about 7.5% cellulose, about 7.5% caustic soda and about 38% carbon disulfide, and the viscose at the time of extrusion has a salt test of 14.5 to 15.5 and a ball fall viscosity of 80 seconds, the spinning bath contains about 7.6% sulfuric acid, about 3.9% zinc sulfate and about 12% sodium sulfate, and is maintained at a temperature of about 38 degrees centigrade, the stretch bath contains about 3.4% sulfuric acid, about 1.75% zinc sulfate and about 5.4% sodium sulfate and is maintained at about 90 degrees centigrade, and the filaments are stretched in the stretch bath about 95% to 100%.

7. The fiber is defined in claim 1 having a wet tenacity between 2.1 and 2.5 grams per denier, a conditioned tenacity between 4.0 and 4.4 grams per denier, a wet extensibility between 18.5 and 22.5%, a conditioned extensibility between 16.5 and 19.5% and a wet modulus between 7.0 and 9.0.

8. A fabric formed of regenerated cellulose fibers as defined in claim 1.

9. A fabric formed of cotton and from 1% to 99% by weight of the fabric of regenerated cellulose fibers as defined in claim 1.

10. A fabric formed of polyester and from 1% to 99% by weight of the fabric of regenerated cellulose fibers as defined in claim 1.

11. A regenerated cellulose fiber having a wet tenacity about 2.0 to 3.5 grams per denier, a conditioned tenacity of about 3.7 to 5.3 grams per denier, a wet extensibility between about 13% and 25%, a conditioned extensibility between 15% and 22%, and having a multi-lobular, skin-core cross-section wherein the core is surrounded by a continuous uninterrupted skin having a smooth periphery.

12. The fiber is defined in claim 11 having a wet tenacity between 2.1 and 2.5 grams per denier, a conditioned tenacity between 4.0 and 4.4 grams per denier, a wet extensibility between 18.5% and 22.5%, a conditioned extensibility between 16.5 and 19.5 and a wet modulus between 7.0 and 9.0.

* * * * *

UNITED STATES PATENT AND TRADEMARK OFFICE

CERTIFICATE OF CORRECTION

PATENT NO. : 4,242,405

DATED : December 30, 1980

INVENTOR(S) : Gregory C. Bockno

It is certified that error appears in the above-identified patent and that said Letters Patent are hereby corrected as shown below:

In column 4, line 53, after "35 ", insert --- C ---.

In column 6, line 49, delete "one", and substitute --- tow ---.

In column 7, line 26, delete "through", and substitute --- strength ---.

In column 8, line 5, delete "IV", and substitute --- VI ---.

In column 8, line 6, delete "enhances", and substitute --- enhanced ---.

In column 9, after line 15, insert --- TABLE I ---.

In column 10, line 10 delete "$W_2$0.0", and substitute --- $W^2$ 0.0 ---.

In Table III, line 4, delete "$NaSO_4$", and substitute --- $Na_2SO_4$ ---.

In column 11, line 5, after "ball fall", insert --- viscosity ---.

In column 12, line 15 delete "is", and substitute --- as ---.

Signed and Sealed this

*Seventeenth* Day of *March 1981*

[SEAL]

*Attest:*

RENE D. TEGTMEYER

*Attesting Officer* *Acting Commissioner of Patents and Trademarks*